US009599931B2

(12) United States Patent
Anderson, Jr. et al.

(10) Patent No.: US 9,599,931 B2
(45) Date of Patent: Mar. 21, 2017

(54) FLOATING TONER PORT INTERFACE WITH A REPLACEABLE UNIT OF AN ELECTROPHOTOGRAPHIC IMAGE FORMING DEVICE

(71) Applicant: Lexmark International, Inc., Lexington, KY (US)

(72) Inventors: James Daniel Anderson, Jr., Harrodsburg, KY (US); Charles Alan Bast, Winchester, KY (US); Brian Scott Carpenter, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/739,163

(22) Filed: Jun. 30, 2015

(65) Prior Publication Data

US 2016/0299456 A1 Oct. 13, 2016

Related U.S. Application Data

(60) Provisional application No. 62/144,523, filed on Apr. 8, 2015.

(51) Int. Cl.
*G03G 15/08* (2006.01)

(52) U.S. Cl.
CPC ..... *G03G 15/0886* (2013.01); *G03G 15/0877* (2013.01)

(58) Field of Classification Search
CPC ..... G03G 15/0875; G03G 15/0839; G03G 15/0886; G03G 2215/066; G03G 2215/068;

(Continued)

(56) References Cited

U.S. PATENT DOCUMENTS 5,614,996 A 3/1997 Tanda
6,041,212 A * 3/2000 Okada ..... G03G 15/0822 399/359

(Continued)

OTHER PUBLICATIONS

Attached Information Disclosure Statement containing annotated photographs of an imaging unit compatible with the Dell Inc. 5130 laser printer and a toner channel compatible with the Lexmark International, Inc. C935 laser printer.

(Continued)

*Primary Examiner* — Francis Gray
(74) *Attorney, Agent, or Firm* — Justin M. Tromp

(57) ABSTRACT

An electrophotographic image forming device includes a toner channel having an outlet port positioned on a housing that includes a flexible member that allows the housing and the outlet port to move within the image forming device. A shutter is positioned on the housing and is movable between a closed position and an open position. A replaceable unit includes a toner reservoir and an inlet port. The inlet port is formed on an extension from the replaceable unit. Upon insertion of the replaceable unit into the image forming device, the extension is closely and matably received by the housing and the outlet port aligns with the inlet port permitting toner transfer from the toner channel to the replaceable unit. Insertion of the replaceable unit into the image forming device causes the shutter to open and removal of the replaceable unit from the image forming device causes the shutter to close.

22 Claims, 15 Drawing Sheets

(58) Field of Classification Search
CPC ..... G03G 2215/0692; B65D 47/28; B65D 47/286; B65D 2585/6892
See application file for complete search history.

(56) References Cited

U.S. PATENT DOCUMENTS

| | | | | |
|---|---|---|---|---|
| 8,761,639 | B1 | 6/2014 | Leemhuis et al. | |
| 8,873,996 | B1 | 10/2014 | Buchanan et al. | |
| 8,948,659 | B2 | 2/2015 | Baker et al. | |
| 2007/0212118 | A1* | 9/2007 | Nagae | G03G 15/0875 399/260 |
| 2007/0248384 | A1 | 10/2007 | Kawai | |
| 2008/0240779 | A1 | 10/2008 | Ogashiwa | |
| 2010/0209137 | A1* | 8/2010 | Takiguchi | G03G 21/1821 399/111 |
| 2012/0027467 | A1* | 2/2012 | Okuda | G03G 15/0875 399/262 |
| 2012/0219330 | A1* | 8/2012 | Kikuchi | G03G 15/0886 399/262 |
| 2012/0263503 | A1 | 10/2012 | Nagashima | |
| 2013/0243492 | A1 | 9/2013 | Shimizu et al. | |
| 2013/0287447 | A1* | 10/2013 | Baker | G03G 15/0886 399/260 |
| 2013/0287448 | A1* | 10/2013 | Baker | G03G 15/0886 399/260 |
| 2014/0140735 | A1* | 5/2014 | Oda | G03G 15/0886 399/258 |
| 2015/0139698 | A1 | 5/2015 | Leemhuis et al. | |
| 2016/0062271 | A1* | 3/2016 | Leemhuis | G03G 15/0886 399/262 |

OTHER PUBLICATIONS

U.S. Appl. No. 14/739,150, filed Jun. 15, 2015.
International Search Report and Written Opinion of the International Searching Authority dated Oct. 24, 2016 for PCT Application No. PCT/US2016/026548.

* cited by examiner

FLOATING TONER PORT INTERFACE WITH A REPLACEABLE UNIT OF AN ELECTROPHOTOGRAPHIC IMAGE FORMING DEVICE

CROSS REFERENCES TO RELATED APPLICATIONS

This application claims priority to U.S. Provisional Patent Application Ser. No. 62/144,523, filed Apr. 8, 2015, entitled "Floating Toner Port Interface with a Replaceable Unit of an Electrophotographic Image Forming Device," the content of which is hereby incorporated by reference in its entirety.

BACKGROUND

1. Field of the Disclosure

The present disclosure relates generally to image forming devices and more particularly to a floating toner port interface with a replaceable unit of an electrophotographic image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. The image turning device's main toner supply, which is consumed relatively quickly, is provided in a large reservoir in a first replaceable unit, which may be referred to as a toner cartridge. Relatively longer life components are provided in one or more additional replaceable units. For example, the developer roll, toner adder roll, doctor blade and a relatively small reservoir of toner (in the case of a single component development image forming device) or the magnetic roll and a relatively small reservoir containing a mix of toner and magnetic carrier beads (in the case of a dual component development image forming device) may be provided in a second replaceable unit, which may be referred to as a developer unit. The photoconductive drum, charge roll and cleaner blade/roll may be provided in a third replaceable unit, which may be referred to as a photoconductor unit. This configuration allows replenishment of the image forming device's toner supply without replacing the developer unit or the photoconductor unit. This configuration also allows the developer unit and the photoconductor unit to be repaired or replaced independent of each other and independent of the image forming device's main toner supply.

During operation, toner is periodically transferred from the relatively large reservoir in the toner cartridge through an outlet port on the toner cartridge to the relatively small reservoir in the developer unit through an inlet port on the developer unit. Toner may be transferred directly from the outlet port to the inlet port or indirectly through an intermediate component, such as a chute or duct, connecting the outlet port of the toner cartridge to the inlet port of the developer unit. The position of the photoconductor unit may be controlled relative to the frame of the image forming device and the position of the developer unit may be controlled in relative to the photoconductor unit in order to ensure proper development of toner from the developer unit onto the surface of the photoconductive drum. Any disturbance to the force balance on the developer unit may upset the position of the developer unit relative to the photoconductor unit, which may, in turn, result in print defects.

One potential source of unwanted force on the developer unit is a separable connection of the inlet port of the developer unit to the corresponding outlet port of the toner cartridge (or the intermediate component). Specifically, positional variation of the inlet port of the developer unit relative to the corresponding outlet port upon installation of the developer unit into the image forming device may result in force variation on the developer unit. One solution is to surround the inlet port with a soft, thick foam seal. The softness and thickness of the foam seal accommodates positional variation between the inlet port and the corresponding outlet port while applying a low force on the developer unit. However, foam seals of this type are often prone to toner leaking.

Another solution is to fix the developer unit to the photoconductor unit and to transfer toner from the toner cartridge through a separable connection to an inlet port on the photoconductor unit. The toner received by the inlet port on the photoconductor unit is then passed through a flexible tube that has a fixed connection at one end to a portion of the photoconductor unit in fluid communication with the inlet port on the photoconductor unit and a fixed connection at the other end to an entry for toner into the developer unit. The photoconductor unit is less sensitive to forces that result from positional variation of its inlet port since the position of the photoconductor unit is controlled relative to the frame of the image forming device. The flexible tube connected to the inlet port of the developer unit accommodates positional variation of the developer unit while applying a low force on the developer unit. However, this solution adds complexity and prevents the user from repairing or replacing the developer unit independent of the photoconductor unit or vice versa.

Another solution is to fix the developer unit to the image forming device and to transfer toner from the toner cartridge to the developer unit through a flexible tube to the inlet port of the developer unit. The flexible tube accommodates positional variation of the developer unit while applying a low force on the developer unit. However, this solution prevents the user from easily repairing or replacing the developer unit and instead requires disassembly of the developer unit from the image forming device.

Accordingly, a separable connection to an inlet port of a developer unit that accommodates positional variation of the developer unit while minimizing toner leakage is desired.

SUMMARY

An electrophotographic image forming device according to one example embodiment includes a toner channel having an outlet port in fluid communication with a toner supply of the image forming device. The outlet port is positioned on a housing that includes a flexible member that allows the housing and the outlet port to move within the image forming device. A shutter is positioned on the housing and is movable between a closed position blocking the outlet port and an open position unblocking the outlet port. A replaceable unit is insertable into and removable from the image forming device. The replaceable unit includes a toner reservoir and an inlet port in fluid communication with the toner reservoir. The inlet port is formed on an extension from the replaceable unit. Upon insertion of the replaceable unit into the image forming device, the extension is closely and matably received by the housing and the outlet port aligns with the inlet port permitting toner transfer from the toner channel to the replaceable unit. Insertion of the replaceable unit into the image forming device causes the shutter to move from the closed position to the open position and removal of the replaceable unit from the image forming device causes the shutter to move from the open position to the closed position.

An electrophotographic image forming device according to one example embodiment includes a toner channel having an outlet port in fluid communication with a toner supply of the image forming device. The outlet port is formed in a bottom surface of a housing that includes a flexible member that allows the housing and the outlet port to move in two dimensions within the image forming device. A downward facing C-shaped channel is positioned on a bottom of the housing and runs along a front-to-rear dimension of the housing. The bottom surface of the housing having the outlet port defines a top portion of the channel. A replaceable unit is insertable into and removable from the image forming device. The replaceable unit includes a toner reservoir and an inlet port in fluid communication with the toner reservoir. The replaceable unit includes a T-shaped extension on a top of the replaceable unit. The inlet port is formed in a top surface of the T-shaped extension. The T-shaped extension includes a base portion that extends upward from the top of the replaceable unit and a pair of outer ledges that extend away from each other toward opposite sides of the replaceable unit and that run along a front-to-rear dimension of the replaceable unit. Upon insertion of the replaceable unit into the image forming device along the front-to-rear dimensions of the replaceable unit and the housing, contact between the replaceable unit and the housing aligns the C-shaped channel of the housing with the T-shaped extension of the replaceable unit in the two dimensions the housing and the outlet port are allowed to move within the image forming device. The C-shaped channel of the housing closely and matably receives the T-shaped extension of the replaceable unit maintaining the alignment of the C-shaped channel of the housing with the T-shaped extension of the replaceable unit in the two dimensions and the outlet port aligns with the inlet port permitting toner transfer from the toner channel to the replaceable unit.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
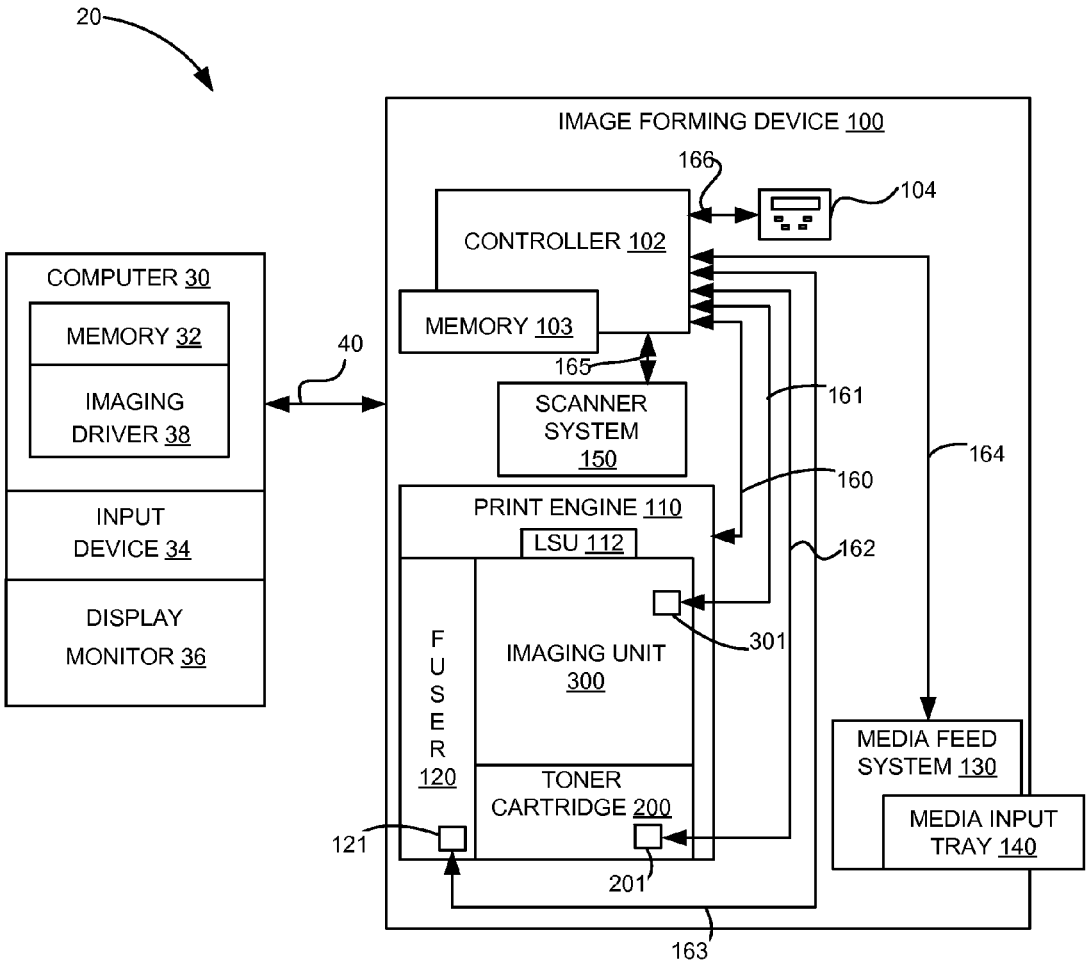
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
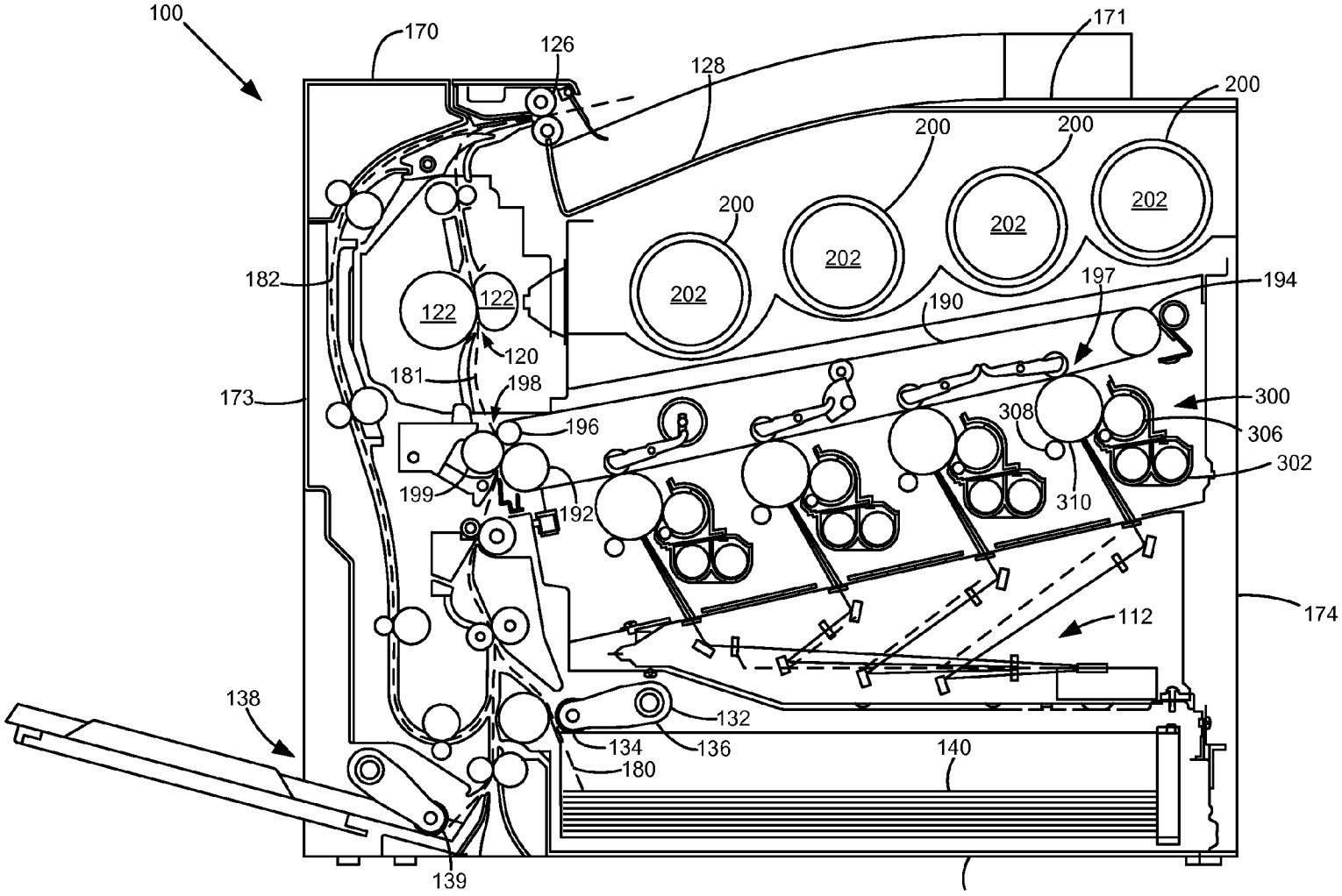
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which are also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner.

In the example embodiment illustrated, image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Magnetic roll 306 includes a stationary core that includes one or more permanent magnets and a rotatable sleeve that encircles the core. Reservoir 302 may include toner agitators, such as paddles, augers, etc., that stir the developer mix and present the developer mix to magnetic roll 306. Each imaging unit 300 also includes a charge roll 308, a photoconductive drum (PC drum) 310 and a cleaner blade or roll (not shown) that collectively form a photoconductor unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. The permanent magnet(s) of magnetic roll 306 attract the carrier beads in reservoir 302 having toner thereon to the outer surface of the sleeve of magnetic roll 306. The sleeve of magnetic roll 306 transports the carrier beads having toner thereon past a trim bar that trims the mix of carrier beads and toner to a predetermined average height on the outer surface of the sleeve. The sleeve of magnetic roll 306 then transports the carrier beads having toner thereon to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a respective first transfer nip 197. In one embodiment, a positive voltage field attracts the toner images from PC drums 310 to the surface of the moving ITM 190. ITM 190 rotates and collects the one or more toner images from PC drums 310 and then conveys the toner images to a media sheet at a second transfer nip 198 formed between a transfer roll 199 and TEM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a multicolor image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art.

While the example image forming device 100 shown in FIG. 2 utilizes a dual component development system, in another embodiment, image forming device 100 utilizes what is commonly referred to as a single component development system. In this embodiment, a toner adder roll in each imaging unit 300 has an outer surface that is in contact with and forms a nip with the outer surface of a corresponding developer roll. As the toner adder roll and the developer roll rotate, the toner adder roll supplies toner in reservoir 302 to the developer roll. The developer roll is electrically charged and electrostatically attracts the toner particles supplied by the toner adder roll. A doctor blade positioned along each developer roll provides a substantially uniform layer of toner on the developer roll. The outer surface of the developer roll is also in contact with and forms a nip with the outer surface of a corresponding PC drum 310. As the developer roll and PC drum 310 rotate, toner particles are electrostatically transferred from the developer roll to the latent image on PC drum 310 forming a toned image on the surface of PC drum 310. PC drum 310 is charged by charge roll 308 and cleaned by a cleaner blade/roll as discussed above.

Figure 3:
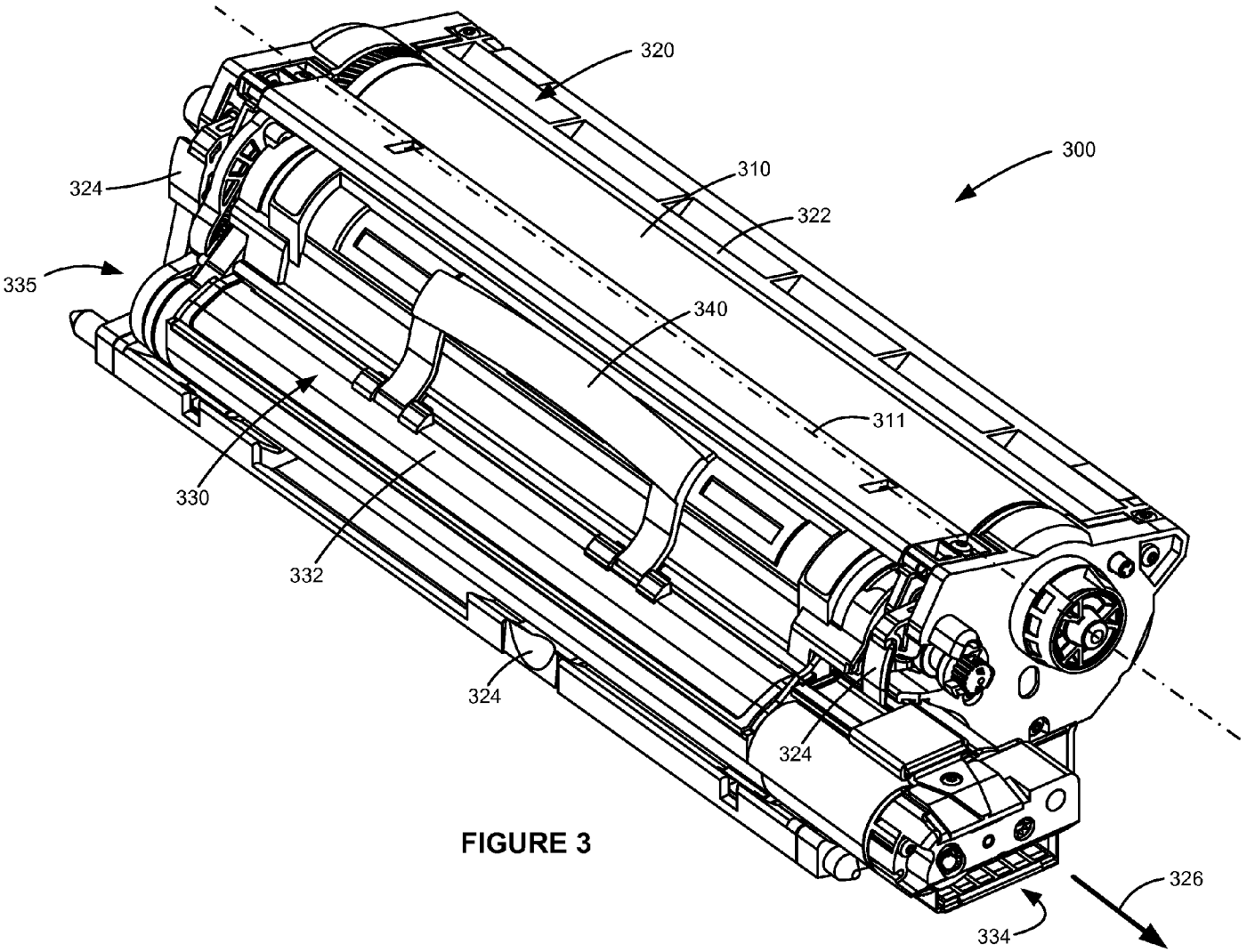
FIG. 3 is a perspective view of an imaging unit including a developer unit and a photoconductor unit according to one example embodiment.
Figure 4:
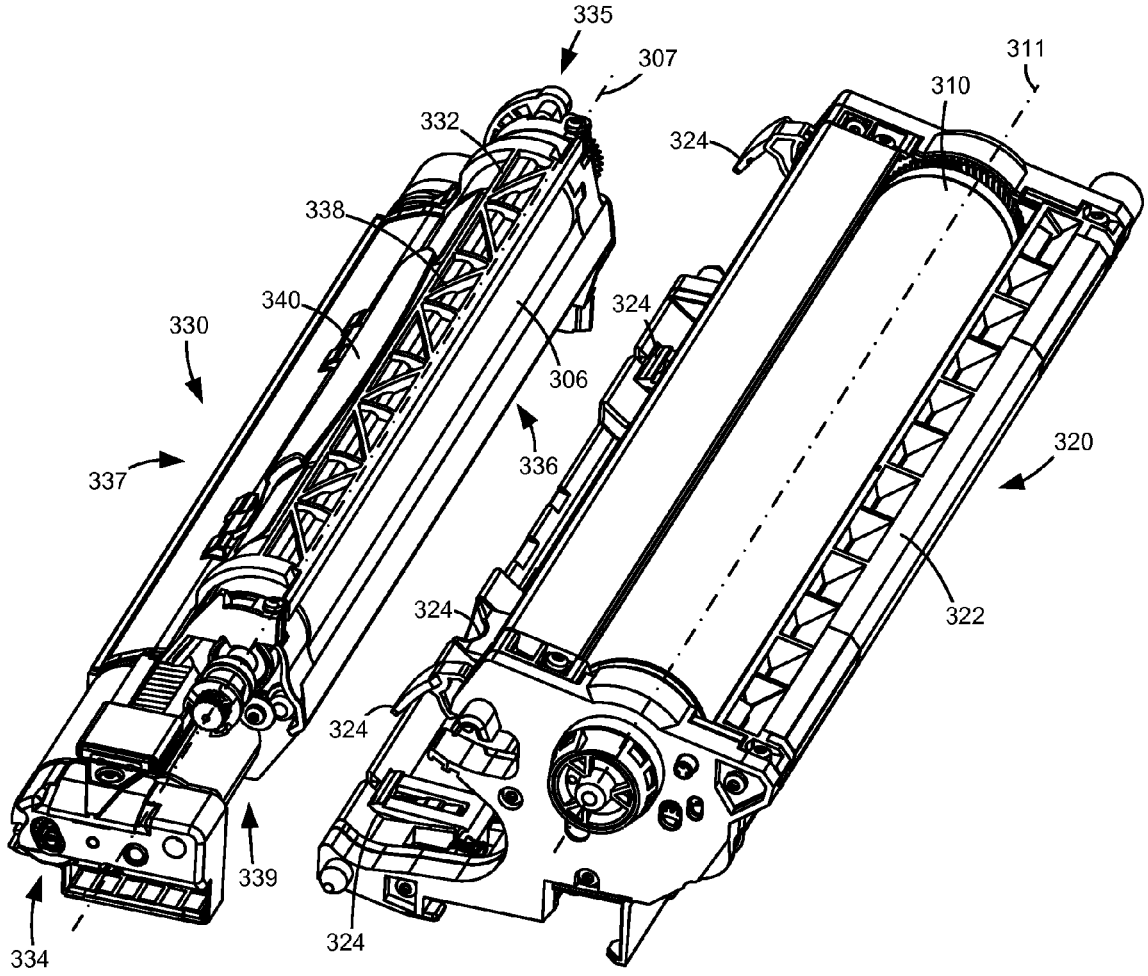
FIG. 4 is a perspective view of the imaging unit shown in FIG. 3 illustrating the developer unit separated from the photoconductor unit according to one example embodiment.

FIGS. 3 and 4 show imaging unit 300 according to one example embodiment. Imaging unit 300 includes a photoconductor unit (PC unit) 320 and a developer unit 330. In the example embodiment illustrated, developer unit 330 is removably coupled to PC unit 320 to permit repair or replacement of developer unit 330 independent of PC unit 320 and vice versa. PC unit 320 includes a housing 322 having PC drum 310 as well as charge roll 308 (FIG. 2) and a cleaner blade/roll (not shown) mounted thereto. Housing 322 may also include one or more user-actuated latches 324 that couple developer unit 330 to PC unit 320 as shown in FIG. 3 for operation in image forming device 100 and that permit a user to separate developer unit 330 from PC unit 320 as shown in FIG. 4. When developer unit 330 is coupled to PC unit 320, imaging unit 300 is insertable into image tuning device 100 via a sliding motion along an insertion direction 326 (along an axial dimension 311 of PC drum 310) as indicated in FIG. 3. In other embodiments, developer unit 330 and PC unit 320 are fixed together such that imaging unit 300 is replaced as a single unit.

Developer unit 330 includes a housing 332 having reservoir 302 therein. Housing 332 extends generally along an axial dimension 307 of magnetic roll 306 (which is substantially parallel to axial dimension 311 of PC drum 310) from a front end 334 of housing 332 to a rear end 335 of housing 332. Front end 334 leads developer unit 330 during insertion of developer unit 330 into image forming device 100. A portion of magnetic roll 306 is exposed from reservoir 302 at one side 336 of housing 332. A handle 340 is optionally positioned on the opposite side 337 of housing 332 to assist with separating developer unit 330 from PC unit 320 and with handling imaging unit 300 when developer unit 330 is coupled to PC unit 320. Housing 332 also includes a top 338 and a bottom 339.

Figure 5:
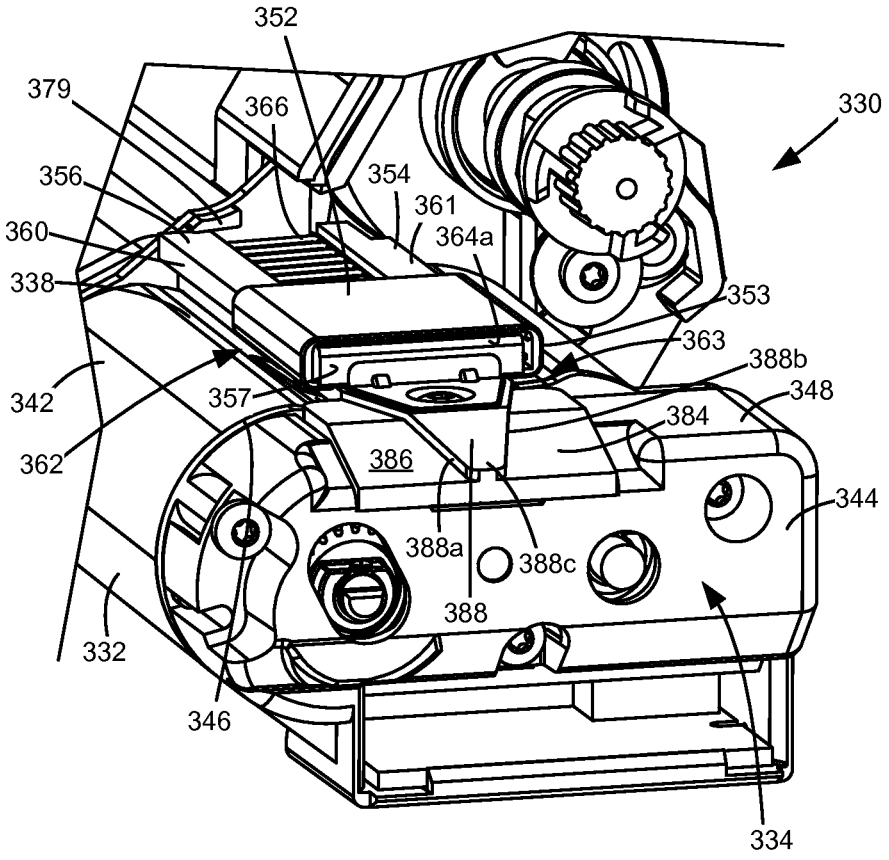
FIG. 5 is a perspective view of a front end of the developer unit having a toner inlet port according to one example embodiment.

FIG. 5 shows front end 334 of developer unit 330 in greater detail. In the embodiment illustrated, front end 334 of housing 332 includes an end cap 344 mounted (e.g., by fasteners such as screws) to a main body 342 of housing 332. In this embodiment, end cap 344 covers a gear train 345 (FIG. 6) that transfers rotational motion between various agitators in reservoir 302. Gear train 345 is positioned between an inner side of end cap 344 and the outer side of a front wall 346 of reservoir 302 that separates reservoir 302 from gear train 345. In other embodiments, front end 334 of housing 332 does not include end cap 344 and the outer side of front wall 346 forms the front end 334 of housing 332.

Figure 6:
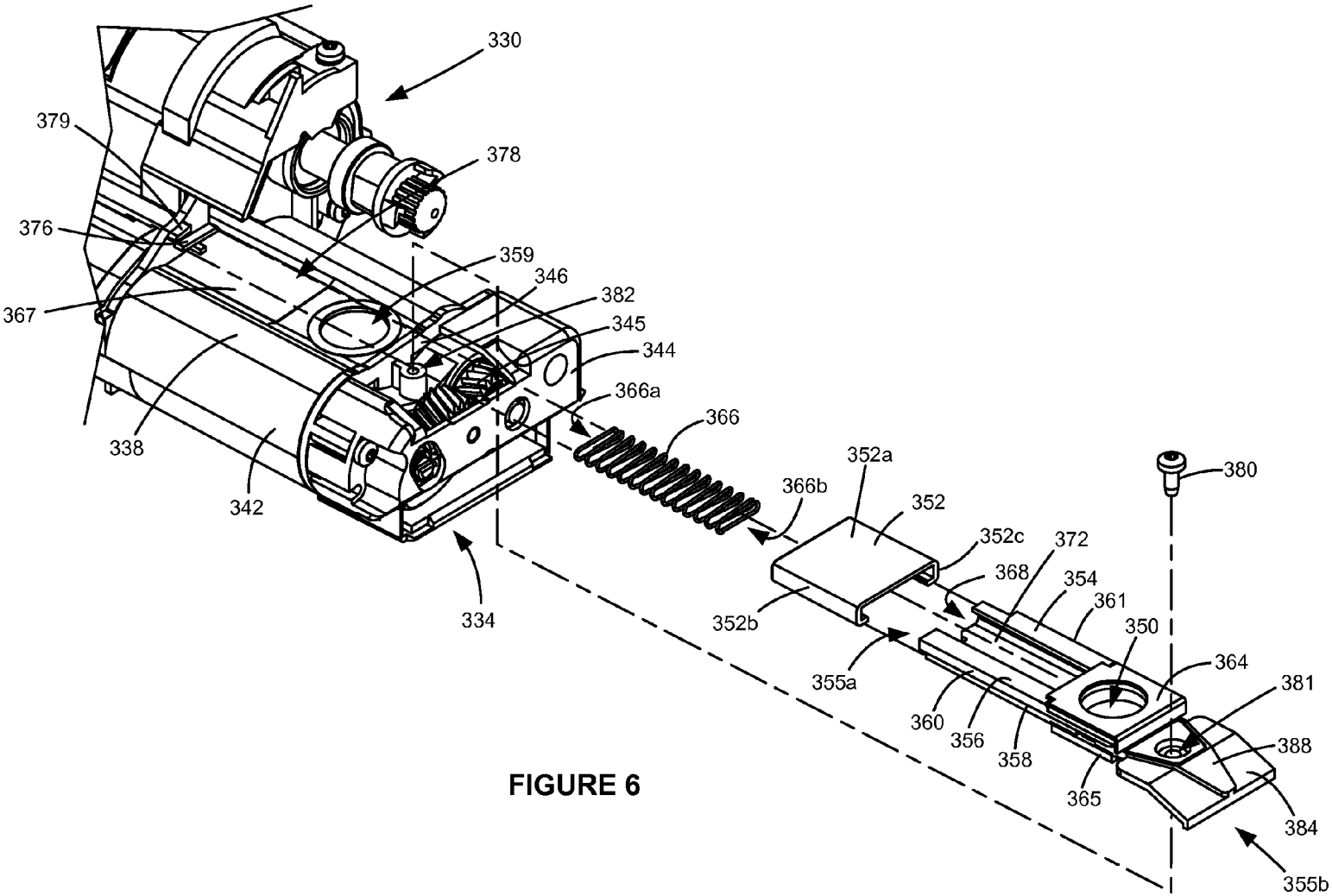
FIG. 6 is an exploded view of a shutter assembly of the developer unit according to one example embodiment.

With reference to FIGS. 5 and 6, developer unit 330 includes an inlet port 350 in fluid communication with reservoir 302 and positioned to receive toner from a corresponding outlet port to replenish reservoir 302 as discussed in greater detail below as toner is consumed from reservoir 302 by the printing process. In the example embodiment illustrated, inlet port 350 is positioned on top 338 of housing 332 near front end 334, such as on top of main body 342 near front wall 346. In some embodiments, housing 332 includes a shutter 352 that is slidably movable between a closed position blocking inlet port 350 to prevent toner from escaping inlet port 350 (as shown in FIG. 5) and an open position unblocking inlet port 350 to permit toner to enter inlet port 350. In the embodiment illustrated, shutter 352 slides rearward relative to housing 332 as shutter 352 moves from the closed position to the open position and forward relative to housing 332 as shutter 352 moves from the open position to the closed position.

Figure 7:
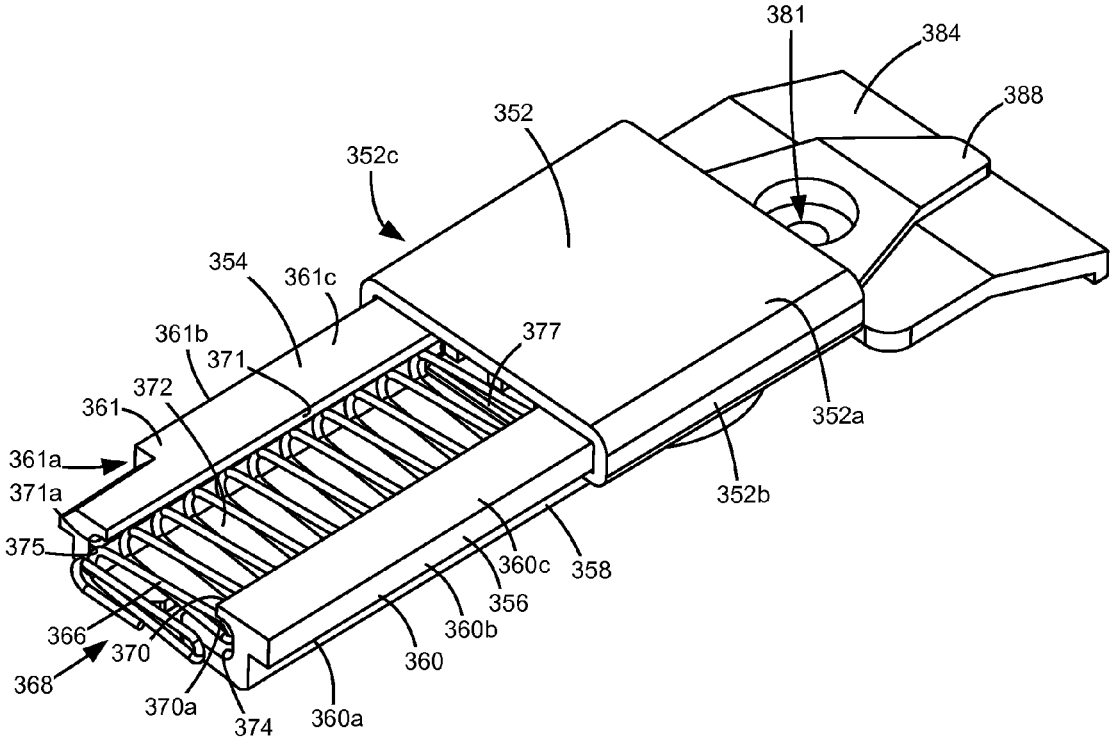
FIG. 7 is a perspective view of the shutter assembly shown in FIG. 6.

With reference to FIGS. 5-7, a shutter guide 354 guides the movement of shutter 352. In the example embodiment illustrated, shutter guide 354 is a separate component from main body 342 of housing 332 that is attached to main body 342. In other embodiments, shutter guide 354 is formed integrally with main body 342 of housing 332. Shutter guide 354 includes a T-shaped extension 356 on the top 338 of housing 332 that runs along a front-to-rear dimension of housing 332 (along axial dimension 307 of magnetic roll 306). Extension 356 includes a base portion 358 that extends upward from the top 338 of housing 332 and forms the vertical portion of the T-shape. Inlet port 350 is formed in the top of base portion 358, near the front of extension 356. Where shutter guide 354 is a separate component attached to main body 342, main body 342 includes a corresponding inlet 359 that is aligned with inlet port 350 when shutter guide 354 is attached to main body 342 in order to permit toner to enter reservoir 302. Extension 356 also includes a pair of outer ledges 360, 361 that extend away from each other toward opposite sides of housing 332 and form the horizontal portions of the T-shape. Outer ledges 360, 361 are positioned at substantially the same height as each other and run along the front-to-rear dimension of housing 332. A pocket 362, 363 is formed below each outer ledge 360, 361 between a top surface 367 of housing 332 and a bottom surface 360*a*, 361*a* of the respective outer ledge 360, 361. Each outer ledge 360, 361 also includes an outer side surface 360*b*, 361*b* and a top surface 360*c*, 361*c*.

Shutter 352 is positioned on extension 356 of shutter guide 354. Shutter 352 includes a base 352*a* that forms the blocking portion of shutter 352 and flanges 352*b* and 352*c* that extend downward from base 352*a* on opposite sides of base 352*a*. Each flange 352*b*, 352*c* wraps under the bottom surface 360*a*, 361*a* of a respective outer ledge 360, 361 to retain shutter 352 on extension 356. When shutter 352 slides between the open and closed positions, base 352*a* of shutter 352 slides along top surfaces 360*c*, 361*c* of outer ledges 360, 361 and flanges 352*b*, 352*c* of shutter 352 slide along bottom surfaces 360*a*, 361*a* and outer side surfaces 360*b*, 361*bc* of outer ledges 360, 361.

A seal 364 may be positioned between shutter 352 and the top of extension 356 to reduce leakage as toner enters inlet port 350. In the example embodiment illustrated, seal 364 is fixed, such as by an adhesive, on the top of extension 356 surrounding inlet port 350. In this embodiment, seal 364 includes an opening therethrough that permits toner to enter inlet port 350. In another embodiment, seal 364 is fixed to the bottom of shutter 352 and slides with shutter 352 against extension 356. Further, where shutter guide 354 is a separate component mounted to housing 332, a seal 365 may be sandwiched between shutter guide 354 and top 338 of housing 332 surrounding inlet 359 in order to reduce leakage as toner passes from inlet port 350 to reservoir 302. Seal 365 includes an opening therethrough that permits toner to pass from inlet port 350 into reservoir 302. Seals 364, 365 may be composed of foam material, such as PORON® from Rogers Corporation, Rogers, Conn., USA.

In some embodiments, shutter 352 is biased toward the closed position blocking inlet port 350. For example, one or more coil compression springs 366 may bias shutter 352 toward the closed position as shown. In the example embodiment illustrated, compression spring 366 is positioned in a C-shaped retention channel 368 formed in shutter guide 354. Channel 368 runs along the front-to-rear dimension of housing 332 between outer ledge 360 and outer ledge 361 of extension 356. Channel 368 is positioned rearward relative to housing 332 from inlet port 350. In this embodiment, shutter guide 354 includes a pair of inner ledges 370, 371 that extend toward each other at approximately the same height as outer ledges 360, 361. Inner ledges 370, 371 are positioned at substantially the same height as each other and run along the front-to-rear dimension of housing 332. Bottom surfaces 370*a*, 371*a* of inner ledges 370, 371 define a top portion of channel 368. Inner ledges 370, 371 are spaced from each other such that a portion of channel 368 is open at the top. A top surface 372 of shutter guide 354 is spaced below bottom surfaces 370*a*, 371*a* of inner ledges 370, 371 and extends in a side-to-side direction of housing 332 between inner ledges 370, 371. Top surface 372 defines a bottom portion of channel 368. Channel 368 is further defined by inner side surfaces 374, 375 that extend upward from top surface 372 to the bottom surfaces 370*a*, 371*a* of ledges 370, 371. Channel 368 constrains spring 366 to prevent spring 366 from binding or displacing. In one embodiment, a height of channel 368 between bottom surfaces 370*a*, 371*a* of inner ledges 370, 371 and top surface 372 is less than a width of channel 368 between inner side surfaces 374, 375.

As shown in FIG. 6, in the example embodiment illustrated, housing 332 includes a rear retention rib 376 that fits inside of the coil compression spring 366 at a rear end 366*a* of spring 366 to secure rear end 366*a* of spring 366. Similarly, as shown in FIG. 7, in the embodiment illustrated, shutter 352 includes a front retention rib 377 on a rear portion of shutter 352 that fits inside of spring 366 at a front end 366*b* of spring 366 to secure front end 366*b* of spring 366.

Figure 8A:
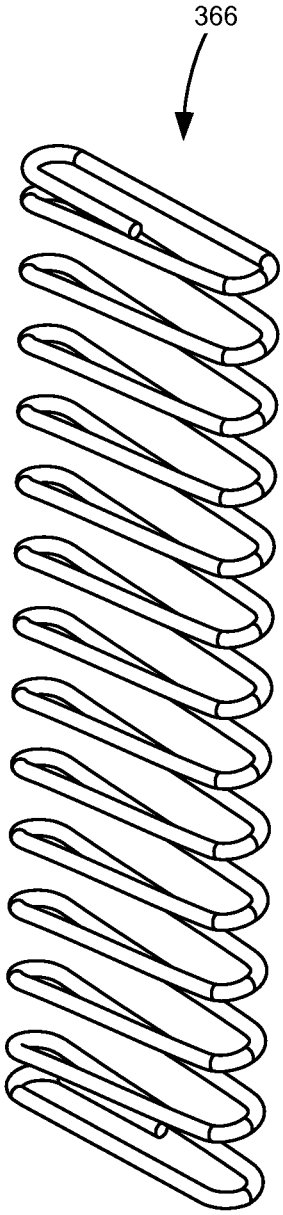
FIG. 8A is a perspective view of a spring used in the shutter assembly according to a first example embodiment.
Figure 8B:
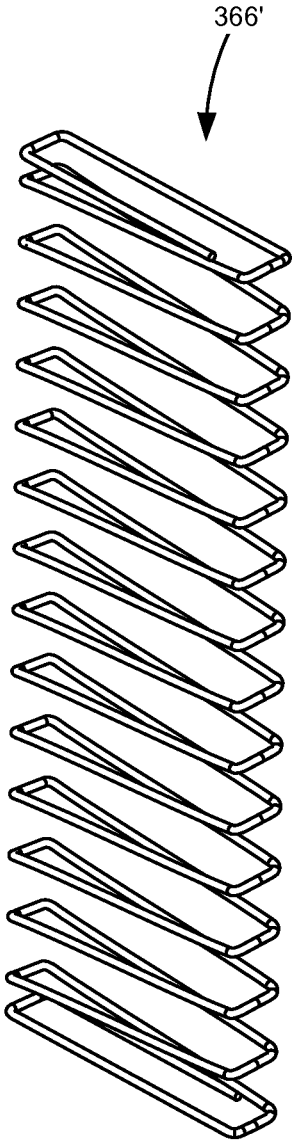
FIG. 8B is a perspective view of a spring used in the shutter assembly according to a second example embodiment.

With reference to FIG. 8A, in one embodiment, spring 366 is a coil compression spring having an oval cross-sectional shape. FIG. 8B shows another example embodiment of a coil compression spring 366' having a rectangular cross-sectional shape suitable for use with shutter 352. The use of a compression spring 366 or 366' having an oval or rectangular cross-sectional shape reduces the space occupied by spring 366 or 366'. This, in turn, reduces the height of channel 368 and extension 356 thereby reducing the space occupied by shutter guide 354. The oval or rectangular cross-sectional shape of spring 366 or 366' is also more resistant to binding than a spring having a circular cross-sectional shape, which may require a rod through the center of the spring in order to prevent the spring from binding. In general, compression spring 366 or 366' having an oval or rectangular cross-sectional shape does not require a rod through its center and, as a result, is easier to assemble onto housing 332.

With reference back to FIGS. 6 and 7, in one embodiment, shutter 352 and shutter guide 354 are assembled on housing 332 by first sliding shutter 352 over a rear end 355*a* of shutter guide 354 toward a front end 355*b* of shutter guide 354 until shutter 352 is positioned over inlet port 350. Spring 366 is then inserted lengthwise into C-shaped channel 368 of shutter guide 354 until front end 366*b* of spring 366 receives front retention rib 377 of shutter 352. With reference to FIGS. 5 and 6, shutter guide 354 is placed in a recess or cavity 378 on top 338 of housing 332 that is sized and shaped to matably receive shutter guide 354. Rear end 366*a* of spring 366 is positioned around rear retention rib 376. Rear end 355*a* of shutter guide 354 is slid into position below a hold-down 379 on housing 332 that prevents shutter guide 354 from tipping forward. A fastener such as a screw 380 is then inserted through a screw hole 381 on shutter guide 354 and a corresponding screw hole 382 on end cap 344 to fix shutter guide 354 to housing 332.

With reference back to FIG. 5, a top surface 348 of front end 334 of housing 332 includes a tapered lead-in ramp 384 that aligns a corresponding outlet port with inlet port 350 as discussed in greater detail below. Ramp 384 leads rearward directly to extension 356 and inlet port 350 in a front-to-rear direction of housing 332. In one embodiment, ramp 384 is positioned immediately in front of extension 356 and inlet port 350 relative to housing 332 and is aligned in the side-to-side dimension of housing 332 with extension 356 and inlet port 350. Ramp 384 is positioned vertically lower than outer ledges 360, 361 and inlet port 350. Ramp 384 includes an inclined surface 386 that inclines upward as it extends rearward relative to housing 332. Ramp 384 may also include a substantially flat plateau surface 387 that runs from a rear end of inclined surface 386 to a front end of extension 356. Ramp 384 may also include a V-shaped wedge 388 that widens in the side-to-side dimension of housing 332 as it travels rearward away from front end 334. Specifically, wedge 388 includes outer side surfaces 388*a*, 388*b* that face away from each other and that are spaced further from each other in the side-to-side dimension of housing 332 as side surfaces 388*a*, 388*b* extend rearward. A top surface 388*c* of wedge 388 may form a portion of inclined surface 386 and/or plateau surface 387 of ramp 384. In some embodiments, ramp 384 is formed on the top surface of end cap 344 and/or main housing body 342. In the example embodiment illustrated, ramp 384 is formed on a front portion of shutter guide 354.

Figure 9A:
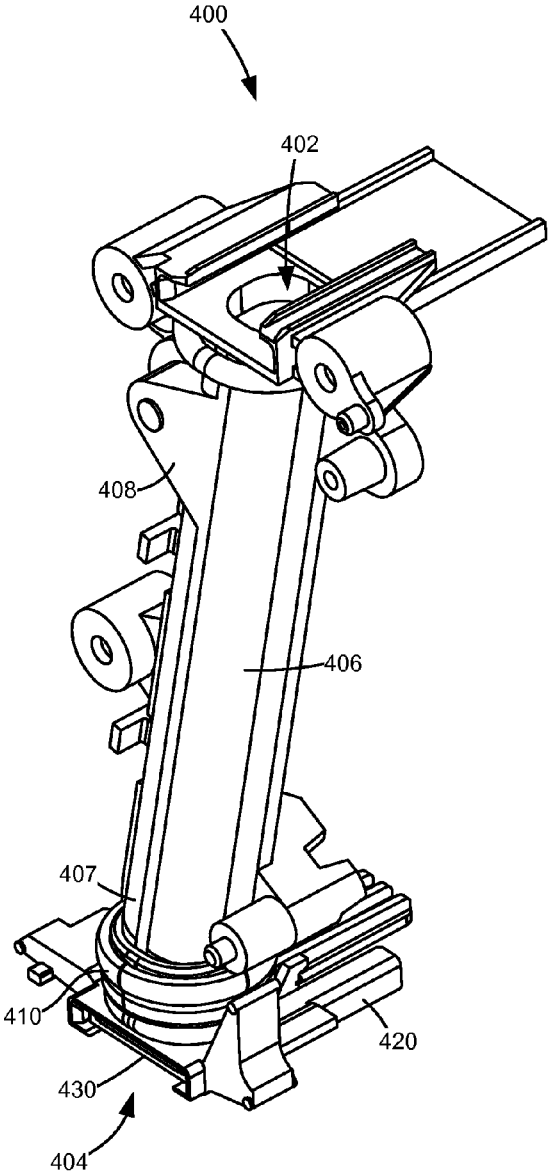
FIG. 9A is a front perspective view of a toner channel having an inlet port for receiving toner from a toner cartridge and an outlet port for delivering toner to the toner inlet port of the developer unit according to one example embodiment.
Figure 9B:
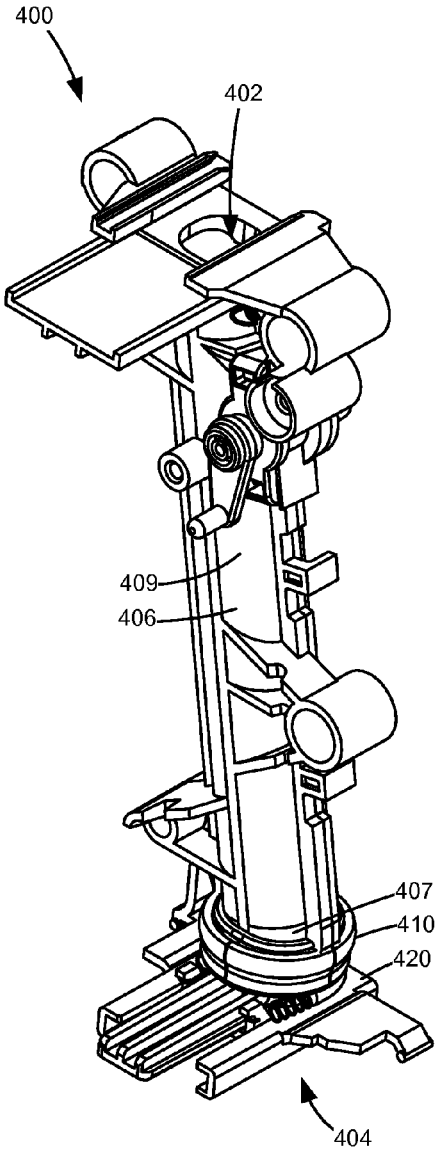
FIG. 9B is a rear perspective view of the toner channel shown in FIG. 9A.

FIGS. 9A and 9B show a toner channel 400 that delivers toner from toner cartridge 200 to a corresponding developer unit 330. Toner channel 400 includes an inlet port 402 that mates with an outlet port of toner cartridge 200 when toner cartridge 200 is installed in image forming device 100 to receive toner from toner cartridge 200. Toner channel 400 also includes an outlet port 404 (FIG. 10C) that mates with inlet port 350 of developer unit 330 when developer unit 330 is installed in image forming device 100 to deliver toner to developer unit 330. Toner channel 400 includes a primarily vertical tube 406 that has a duct running through it. Toner received at inlet port 402 moves through the duct in tube 406 via gravity toward outlet port 404. One or more toner agitators may also be positioned in the duct in order to prevent toner from clogging and to help move toner toward outlet port 404. Toner channel 400 includes a front 408 that faces the direction from which developer unit 330 is inserted into image forming device 100 and a rear 409 positioned opposite front 408.

Figure 10A:
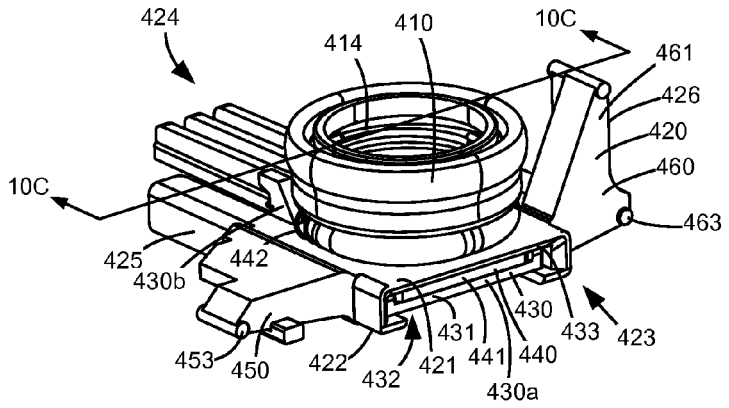
FIG. 10A is a front perspective view of a floating port housing and a flexible coupling member of the toner channel according to one example embodiment.
Figure 10B:
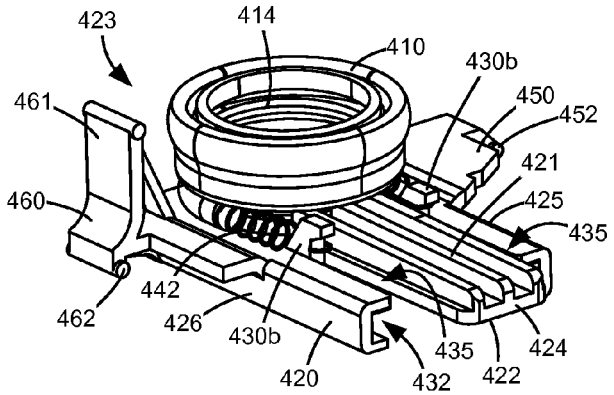
FIG. 10B is a rear perspective view of the floating port housing and the flexible coupling member shown in FIG. 10A.
Figure 10C:
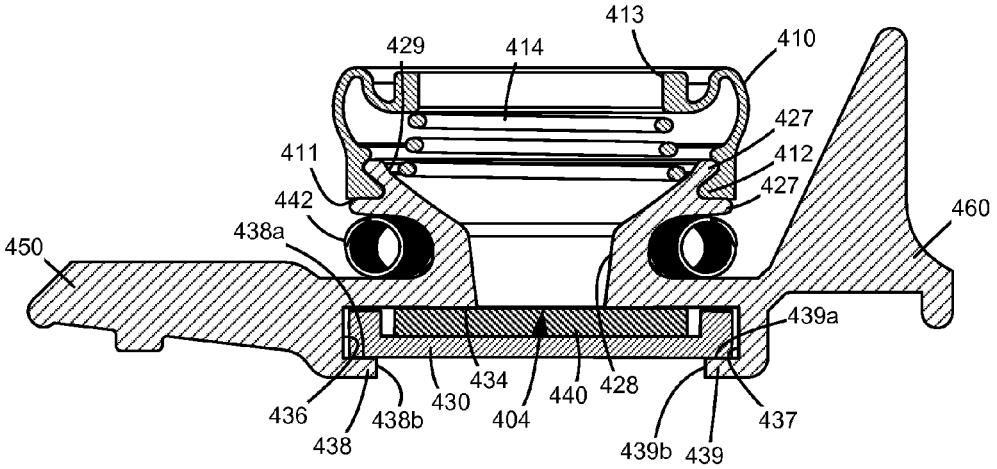
FIG. 10C is a cross-sectional view of the floating port housing and the flexible coupling member shown in FIGS. 10A and 10B.

Outlet port 404 is positioned on a floating port housing 420 that is connected to a bottom end 407 of tube 406 by a flexible coupling member 410. Coupling member 410 is a hollow, sleeve-shaped member that is open at the top and bottom to allow toner to pass from tube 406 through coupling member 410 to outlet port 404. Coupling member 410 is composed of an elastic material that permits housing 420 to move vertically and horizontally independent of tube 406 as discussed in greater detail below. With reference to FIGS. 10A-10C, housing 420 includes a top 421, a bottom 422, a front 423, a rear 424 and a pair of sides 425, 426. Outlet port 404 is formed in bottom 422 of housing 420. Front 423 faces the direction from which developer unit 330 is inserted into image forming device 100. Housing 420 includes a primarily vertical duct 428 that extends from a top opening 429 of duct 428 to outlet port 404. Top opening 429 receives toner from bottom end 407 of tube 406 through coupling member 410. In one embodiment, top opening 429 of duct 428 tapers inward and downward in order to funnel toner toward outlet port 404.

In one embodiment, a bottom end 411 of coupling member 410 tightly wraps around top opening 429 of duct 428. In the embodiment illustrated, the outside of top opening 429 of duct 428 includes retention ribs 427 that engage a corresponding tip 412 formed on an inner side of bottom end 411 of coupling member 410. The engagement between lip 412 and ribs 427 ensures that housing 420 does not separate from coupling member 410 during operation. The engagement between lip 412 and ribs 427 also forms a serpentine path between them that, in combination with the tight connection between coupling member 410 and housing 420, prevents toner from leaking as it moves from coupling member 410 into duct 428. A top end 413 of coupling member 410 may be connected to bottom end 407 of tube 406 in a similar manner. However, the connection of bottom end 411 of coupling member 410 to housing 420 and/or the connection of top end 413 of coupling member 410 to tube 406 may be made by any suitable method, such as, for example, by using an adhesive, fastener or clamp. In one embodiment, a conical compression spring 414 is positioned inside of coupling member 410 and biases housing 420 downward relative to coupling member 410. In the example illustrated, a top end of spring 414 is positioned against an inner side of top end 413 of coupling member 410 and a bottom end of spring 414 is positioned against the surface of top opening 429 of duct 428 of housing 420. Other suitable biasing members may be used to bias housing 420 as desired.

In some embodiments, housing 420 includes a shutter 430 that is slidably movable between a closed position blocking outlet port 404 to prevent toner from escaping outlet port 404 (as shown in FIGS. 10A and 10B) and an open position unblocking outlet port 404 to permit toner to exit outlet port 404. In the embodiment illustrated, shutter 430 slides rearward relative to housing 420 as shutter 430 moves from the closed position to the open position and forward relative to housing 420 as shutter 430 moves from the open position to the closed position.

A downward facing C-shaped channel 432 on the bottom of housing 420 runs along a front-to-rear dimension of housing 420 and guides the motion of shutter 430. A portion of channel 432 is positioned under outlet port 404. Outlet port 404 is formed in a bottom surface 434 of housing 420. Bottom surface 434 defines a top portion of channel 432. Channel 434 is further defined by a pair of inner side wall surfaces 436, 437 that extend vertically downward from bottom surface 434. Housing 420 also includes ledges 438, 439 that are spaced below bottom surface 434 and extend toward each other from inner side wall surfaces 436, 437. Ledges 438, 439 are positioned at substantially the same height as each other and run along the front-to-rear dimension of housing 420. Top surfaces 438*a*, 439*a* of ledges 438, 439 define a bottom portion of channel 432.

In the example embodiment illustrated, shutter 430 includes a substantially planar segment 430*a* and a pair of spring retention posts 430*b* that extend upward from planar segment 430*a*. Planar segment 430*a* is positioned in C-shaped channel 432 and forms the blocking portion of shutter 430. When shutter 430 slides between the open and closed positions, planar segment 430*a* slides along top surfaces 438*a*, 439*a* of ledges 438, 439 between inner side wall surfaces 436, 437. Posts 430*b* extend upward through a pair of corresponding slits 435 in housing 420. Slits 435 are positioned on opposite sides of outlet port 404 from each other and extend along the front-to-rear dimension of housing 420. When shutter 430 slides between the open and closed positions, posts 430*b* travel rearward and forward relative to housing 420 in slits 435.

With reference to FIG. 10C, a seal 440 may be positioned between shutter 430 and bottom surface 434 of housing 420. In the example embodiment illustrated, seal 440 is fixed to the top of shutter 430 and slides with shutter 430 against bottom surface 434. In another embodiment, seal 440 is fixed, such as by an adhesive, on the bottom surface 434 of housing 420 and includes an opening to permit toner to leave outlet port 404. Seal 440 may be composed of foam material, such as PORON® from Rogers Corporation, Rogers, Conn., USA.

With reference back to FIGS. 10A and 10B, in some embodiments, shutter 430 is biased toward the closed position blocking outlet port 404. For example, an extension spring 442 that attaches at its ends to posts 430*b* and wraps in front of duct 428 may bias shutter 430 toward the closed position as shown. Other suitable biasing members may be used as desired.

Housing 420 includes a positioning guide 450, 460 on each side 425, 426 of housing 420. Positioning guides 450, 460 aid in positioning housing 420 in image forming device 100 as discussed in greater detail below. In the embodiment illustrated, positioning guides 450, 460 extend away from each other in a wing-like manner on opposite sides 425, 426 of housing 420. In some embodiments, one or both of positioning guides 450, 460 includes an upward or downward extending protrusion 461 therefrom.

Figure 11:
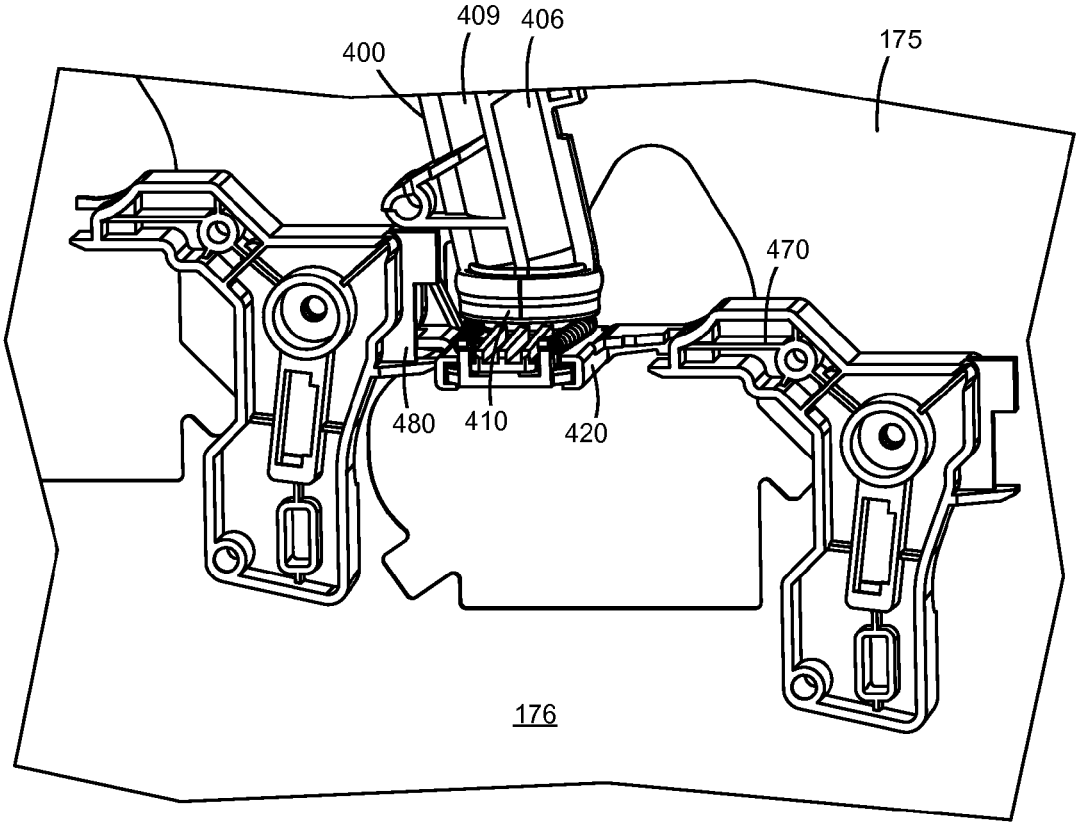
FIG. 11 is a perspective view of the toner channel installed on a frame of the image forming device housing with movement of the floating port housing constrained by a pair of retainers.

FIG. 11 shows a portion of channel 430 mounted to a frame 175 that forms part of housing 170 of image forming device 100. Tube 406 is fixedly mounted to frame 175 by suitable fasteners, such as screws, such that tube 406 is not free to move independent of frame 175. Housing 420 is loosely mounted to frame 170 such that housing 420 is free to move at least vertically and side-to-side relative to tube 406 and frame 175 as a result of the elasticity of coupling member 410.

In the example embodiment illustrated, a pair of retainers 470, 480 that limit the movement of housing 420 relative to tube 406 and frame 175 are fixedly mounted to frame 175 on opposite sides of housing 420. In other embodiments, retainers 470, 480 are formed integrally with frame 175. In some embodiments, retainers 470, 480 prevent housing 420 from moving along the front-to-rear dimension of housing 420 (i.e., along insertion direction 326 of imaging unit 300) and from twisting relative to tube 406 and frame 175. For example, in the embodiment illustrated, housing 420 is sandwiched in the front-to-rear dimension of housing 420 between retainers 470, 480 and frame 175. Specifically, a rear datum surface 452, 462 (FIG. 10B) of each positioning guide 450, 460 is positioned against a corresponding front surface of a corresponding retainer 470, 480 and a front datum surface 453, 463 (FIG. 10A) is positioned against a rear surface 176 of frame 175.

Figure 12:
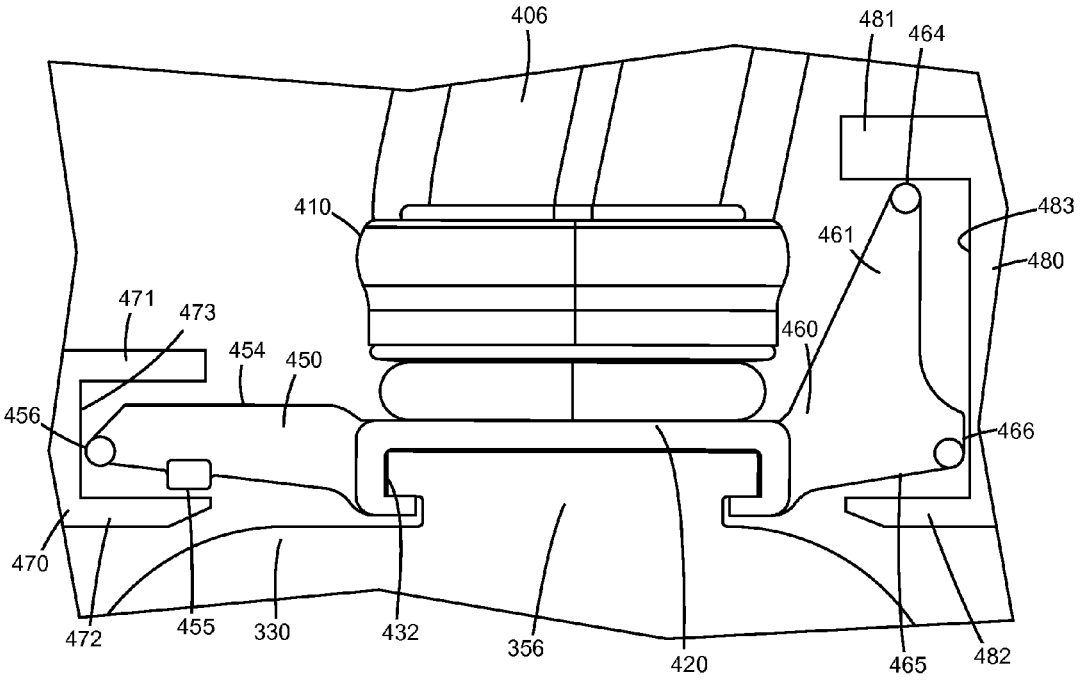
FIG. 12 is a cross-sectional view of the floating port housing constrained by the pair of retainers and mated with the toner inlet port of the developer unit according to one example embodiment.

FIG. 12 shows housing 420 constrained in the side-to-side and vertical dimensions by retainers 470, 480. FIG. 12 also shows housing 420 mated with extension 356 of developer unit housing 330 as discussed in greater detail below. Each retainer 470, 480 includes an upper restraint 471, 481 and a lower restraint 472, 482. Upper restraints 471, 481 and lower restraints 472, 482 limit the vertical movement of each positioning guide 450, 460. A height of each positioning guide 450, 460 is less than a vertical distance between its corresponding upper restraint 471, 481 and lower restraint 472, 482 in order to permit housing 420 to move up and down relative to retainers 470, 480. Specifically, in the embodiment shown, contact between a top surface 454 of positioning guide 450 and upper restraint 471 and between a top surface 464 of protrusion 461 and upper restraint 481 limits the vertical upward movement of housing 420. Similarly, contact between a bottom surface 455 of positioning guide 450 and lower restraint 472 and between a bottom surface 465 of positioning guide 460 and tower restraint 482 limits the vertical downward movement of housing 420. In the embodiment illustrated, contact between top surface 464 of protrusion 461 and upper restraint 481 and between bottom surface 465 of positioning guide 460 and lower restraint 482 also limits the amount that housing 420 can tilt forward or rearward. Further, an overall width of housing 420 from a side surface 456 of positioning guide 450 to a side surface 466 of positioning guide 460 is less than a horizontal distance between a side restraint 473 of retainer 470 and a side restraint 483 of retainer 480 in order to permit housing 420 to move side-to-side relative to retainers 470, 480. Contact between either side surface 456, 466 and its corresponding side restraint 473, 483 limits the side-to-side movement of housing 420.

Figure 13:
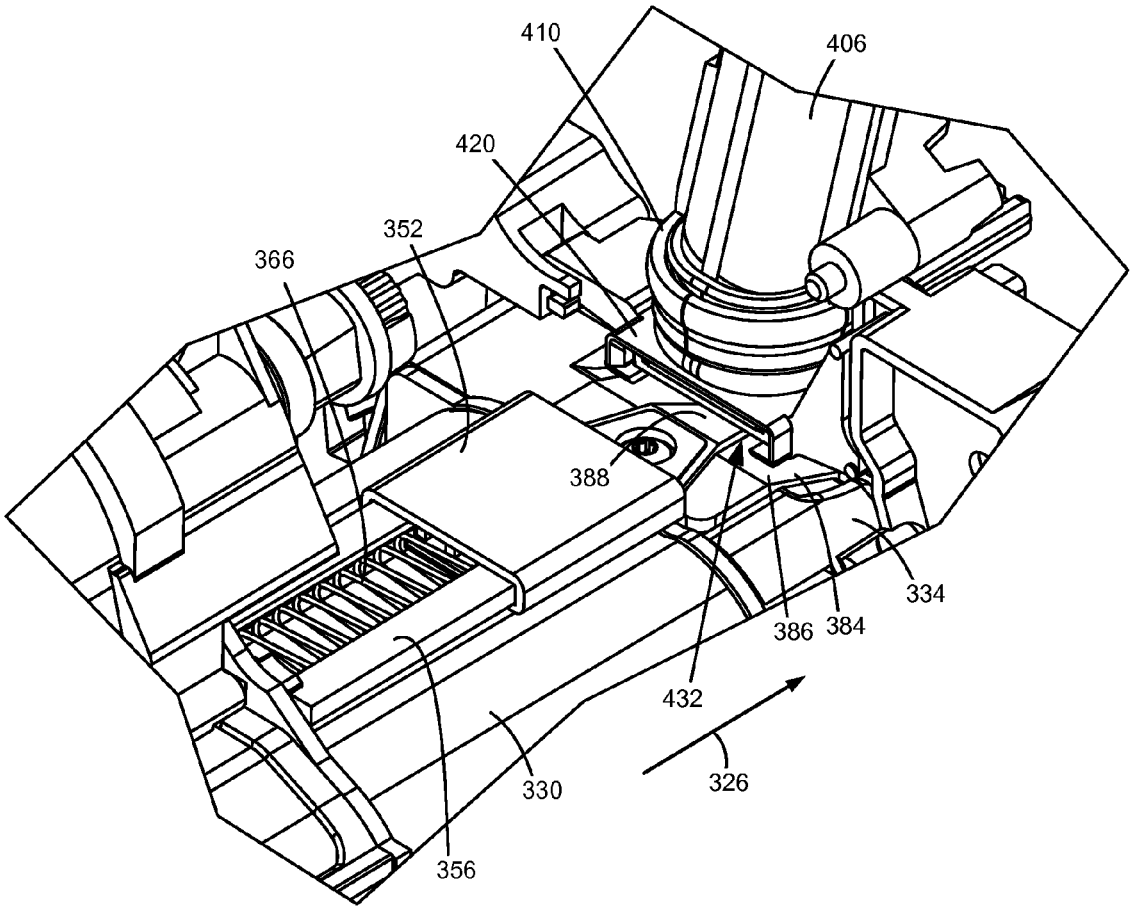
FIG. 13 is a perspective view of the toner inlet port approaching the outlet port of the toner channel as the developer unit is inserted into the image forming device according to one example embodiment.
Figure 14:
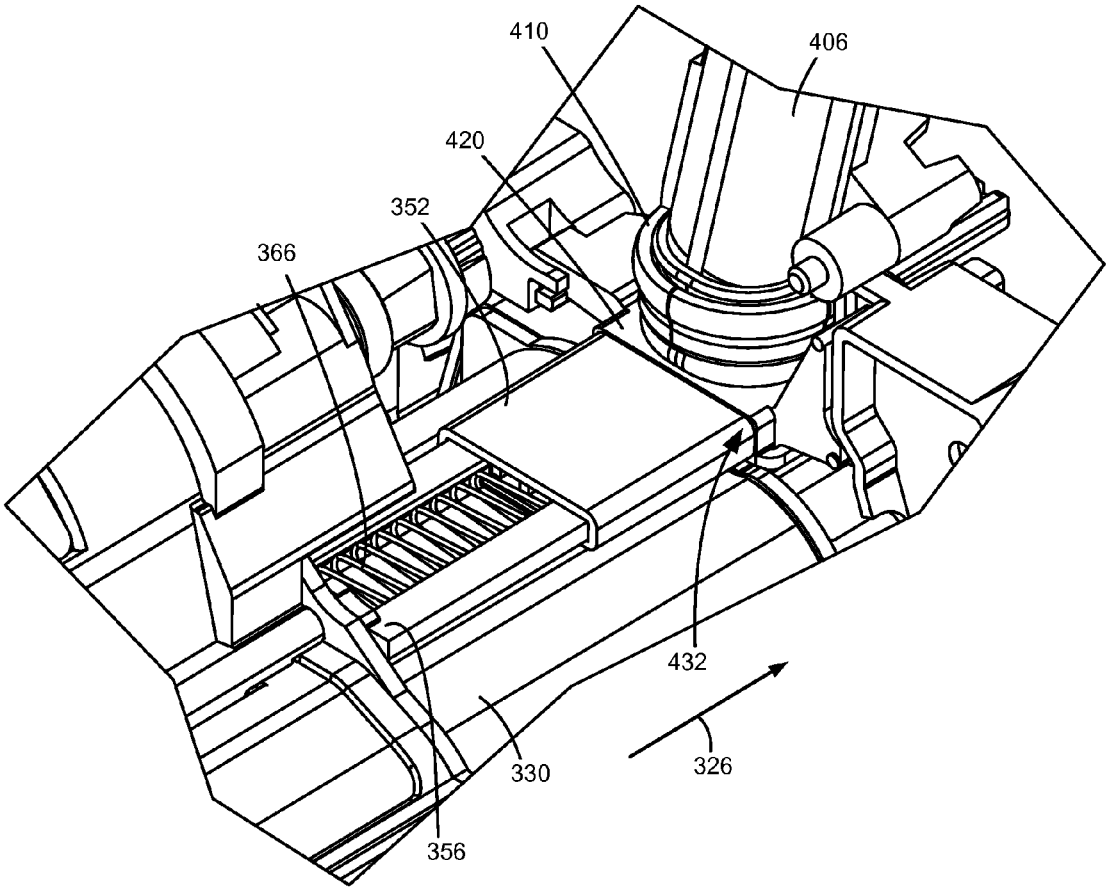
FIG. 14 is a perspective view of the developer unit advanced further into the image forming device according to one example embodiment.
Figure 15:
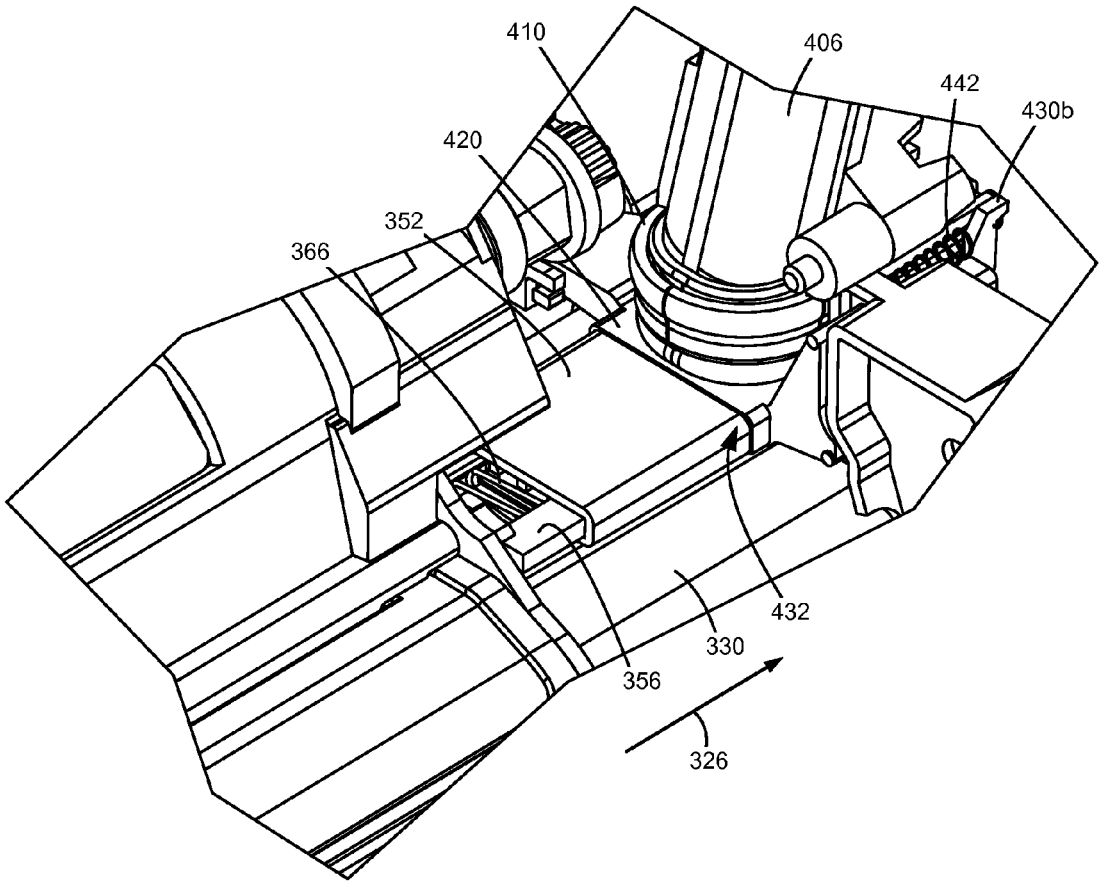
FIG. 15 is a perspective view of the developer unit in its final position installed in the image forming device with the toner inlet port mated with the outlet port of the toner channel according to one example embodiment.

FIGS. 13-15 are sequential views showing how inlet port 350 of developer unit 330 aligns and mates with corresponding outlet port 404 of toner channel 400 as developer unit 330 is inserted into image forming device 100 along insertion direction 326. Frame 175 is omitted from FIGS. 13-15 to more clearly illustrate the interaction between developer unit 330 and floating housing 420. With reference to FIG. 13, when front end 334 of developer unit 330 reaches floating housing 420 of toner channel 400 during insertion of developer unit 330 into image forming device 100, inclined surface 386 of lead-in ramp 384 contacts the bottom 422 of floating housing 420. The incline of surface 386 of ramp 384 causes floating housing 420 to rise upward as developer unit 330 advances along insertion direction 326 in order to control the vertical position of outlet port 404 relative to inlet port 350 to ensure that outlet port 404 aligns with inlet port 350. The elasticity of coupling member 410 permits floating housing 420 to rise relative to tube 406 and frame 175. Further, if outlet port 404 is misaligned in the side-to-side dimension of housing 332 and housing 420, side surface 388*a* or 388*b* (FIG. 5) of V-shaped wedge 388 may contact a corresponding inner side surface 438*b* or 439*b* (FIG. 10C) of ledges 438, 439 of floating housing 420. The widening of wedge 388 in the side-to-side dimension causes floating housing 420 to move sideways as developer unit 330 advances along insertion direction 326 in order to control the side-to-side position of outlet port 404 relative to inlet port 350 to ensure that outlet port 404 aligns with inlet port 350. The elasticity of coupling member 410 permits floating housing 420 to move side-to-side relative to tube 406 and frame 175. In some embodiments, housing 420 is prevented by retainers 470, 480 from moving along the front-to-rear dimension of housing 420 in order to ensure that floating housing 420 is not pushed away from inlet port 350 by the rearward (relative to floating housing 420) force received by floating housing 420 from the contact with developer unit 330 as developer unit 330 is inserted. The front-to-rear position of developer unit 330 is tightly controlled by frame 175 to ensure that inlet port 350 aligns with outlet port 404.

FIG. 14 shows developer unit 330 advanced further toward its final position at a point where T-shaped extension 356 of developer unit 330 reaches C-shaped channel 432 of toner channel 400. When T-shaped extension 356 reaches C-shaped channel 432, a front face 433 (FIG. 10A) of the portion of housing 420 that forms C-shaped channel 432 contacts a front face 353 (FIG. 5) of shutter 352, a front face 357 (FIG. 5) of T-shaped extension 356 contacts a front face 431 (FIG. 10A) of shutter 430 and, in some embodiments, a front face 364*a* (FIG. 5) of upper seal 364 contacts a front face 441 (FIG. 10A) of seal 440. As developer unit 330 advances further, contact between front face 433 of the portion of housing 420 that forms C-shaped channel 432 and front face 353 of shutter 352 causes shutter 352 to slide from the closed position toward the open position as the force from housing 420 overcomes the bias on shutter 352. Similarly, contact between front face 357 of T-shaped extension 356 and front face 431 of shutter 430 causes shutter 430 to slide from the closed position toward the open position as developer unit 330 advances further as the insertion force from developer unit 330 overcomes the bias on shutter 430. As developer unit 330 advances further, T-shaped extension 356 of developer unit 330 is closely and matably received by C-shaped channel 432 of floating housing 420 to maintain the vertical and side-to-side alignment of floating housing 420 with developer unit 330 as shown in FIG. 12. Shutters 430 and 352 continue to slide toward their open positions as developer unit 330 continues to advance.

FIG. 15 shows developer unit 330 in its final position installed in image forming device 100. When developer unit 330 reaches its final position, shutters 352 and 430 are fully open and outlet port 404 is aligned with inlet port 350 permitting the transfer of toner from toner channel 400 to reservoir 302 of developer unit 330. Specifically, toner moving from toner channel 400 to developer unit 330 passes through the duct in tube 406, out the bottom end 407 of tithe 406, through coupling member 410 and outlet port 404 on floating housing 420, through seal 364 surrounding inlet port 350, through inlet port 350, through seal 365 surrounding inlet 359 and into inlet 359 to reservoir 302. Contact between front face 364*a* of upper seal 364 of developer unit 330 and front face 441 of seal 440 of floating housing 420 ensures that outlet port 404 is sealed even as shutter 430 opens until outlet port 404 is aligned with inlet port 350 in order to reduce toner leakage.

This sequence is reversed when developer unit 330 is removed from image forming device 100. As developer unit 330 is removed from image forming device 100, shutters 430 and 352 slide back to their closed positions as a result of the movement of developer unit 330 away from floating housing 420. T-shaped extension 356 of developer unit 330 slides out of and separates from C-shaped channel 432 of floating housing 420. Floating housing 420 travels down the incline of surface 386 of ramp 384 as a result of the bias applied by conical compression spring 414 until developer unit 330 no longer contacts floating housing 420.

Accordingly, floating housing 420 of toner channel 400 provides a separable connection between outlet port 404 and inlet port 350 of developer unit 330 that requires no user interaction other than the normal insertion and removal of developer unit 330 into and out of image forming device 100. The flexibility of coupling member 410 and the freedom of movement permitted by retainers 470, 480 allow lead-in ramp 384 and wedge 388 of developer unit 330 to reposition floating housing 420 relative to housing 332 of developer unit 330 if necessary to ensure that outlet port 404 aligns properly with inlet port 350. The mating engagement between C-shaped channel 432 of floating housing 420 and T-shaped extension 356 of developer unit 330 provides a firm connection between outlet port 404 and inlet port 350 to minimize toner leakage as toner moves from toner channel 400 to reservoir 302.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An electrophotographic image forming device, comprising:

a toner channel having an outlet port in fluid communication with a toner supply of the image forming device, the outlet port is positioned on a housing that includes a flexible member that allows the housing and the outlet port to move within the image forming device, a shutter is positioned on the housing and is movable between a closed position blocking the outlet port and an open position unblocking the outlet port; and a replaceable unit that is insertable into and removable from the image forming device, the replaceable unit includes a toner reservoir and an inlet port in fluid communication with the toner reservoir, the inlet port is formed on an extension from the replaceable unit, wherein upon insertion of the replaceable unit into the image forming device, the extension is closely and matably received by the housing and the outlet port aligns with the inlet port permitting toner transfer from the toner channel to the replaceable unit, wherein insertion of the replaceable unit into the image forming device causes the shutter to move from the closed position to the open position and removal of the replaceable unit from the image forming device causes the shutter to move from the open position to the closed position.

2. The electrophotographic image forming device of claim 1, wherein the flexible member allows the housing and the outlet port to move in two dimensions within the image forming device.

3. The electrophotographic image forming device of claim 1, further comprising:

a downward facing C-shaped channel positioned on a bottom of the housing that runs along a front-to-rear dimension of the housing, the outlet port is formed in a bottom surface of the housing that defines a top portion of the C-shaped channel; and the extension from the replaceable unit includes a T-shaped extension that runs along a front-to-rear dimension of the replaceable unit on a top of the replaceable unit, the inlet port is formed in a top surface of the T-shaped extension, wherein upon insertion of the replaceable unit into the image forming device along front-to-rear dimensions of the replaceable unit and the housing, contact between the replaceable unit and the housing aligns the C-shaped channel of the housing with the T-shaped extension of the replaceable unit and the C-shaped channel of the housing closely and matably receives the T-shaped extension of the replaceable unit maintaining the alignment of the C-shaped channel of the housing with the T-shaped extension of the replaceable unit.

4. The electrophotographic image forming device of claim 3, wherein the shutter is biased toward the closed position and upon insertion of the replaceable unit into the image forming device along the front-to-rear dimensions of the replaceable unit and the housing, a front face of the T-shaped extension contacts the shutter and pushes the shutter from the closed position to the open position.

5. The electrophotographic image forming device of claim 3, wherein the housing and the outlet port are prevented from moving in the front-to-rear dimension of the housing and the flexible member allows the housing and the outlet port to move in two dimensions perpendicular to the front-to-rear dimension of the housing within the image forming device.

6. The electrophotographic image forming device of claim 1, wherein upon insertion of the replaceable unit into the image forming device, contact between the replaceable unit and the housing lifts the housing to a position where the outlet port of the housing is aligned vertically with the inlet port of the replaceable unit.

7. The electrophotographic image forming device of claim 1, wherein upon a forward sliding insertion of the replaceable unit into the image forming device, contact between the replaceable unit and the housing moves the housing to a position where the outlet port of the housing is aligned with the inlet port of the replaceable unit in a side-to-side dimension perpendicular to the forward sliding insertion of the replaceable unit.

8. An electrophotographic image forming device, comprising:

a toner channel having an outlet port in fluid communication with a toner supply of the image forming device, the outlet port is formed in a bottom surface of a housing that includes a flexible member that allows the housing and the outlet port to move in two dimensions within the image forming device, a downward facing C-shaped channel is positioned on a bottom of the housing and runs along a front-to-rear dimension of the housing, the bottom surface of the housing having the outlet port defines a top portion of the C-shaped channel; and a replaceable unit that is insertable into and removable from the image forming device, the replaceable unit includes a toner reservoir and an inlet port in fluid communication with the toner reservoir, the replaceable unit includes a T-shaped extension on a top of the replaceable unit, the inlet port is formed in a top surface of the T-shaped extension, the T-shaped extension includes a base portion that extends upward from the top of the replaceable unit and a pair of outer ledges that extend away from each other toward opposite sides of the replaceable unit and that run along a front-to-rear dimension of the replaceable unit, wherein upon insertion of the replaceable unit into the image forming device along the front-to-rear dimensions of the replaceable unit and the housing, contact between the replaceable unit and the housing aligns the C-shaped channel of the housing with the T-shaped extension of the replaceable unit in the two dimensions the housing and the outlet port are allowed to move within the image forming device, the C-shaped channel of the housing closely and matably receives the T-shaped extension of the replaceable unit maintaining the alignment of the C-shaped channel of the housing with the T-shaped extension of the replaceable unit in the two dimensions and the outlet port aligns with the inlet port permitting toner transfer from the toner channel to the replaceable unit.

9. The electrophotographic image forming device of claim 8, further comprising a shutter positioned on the housing that is movable between a closed position blocking the outlet port and an open position unblocking the outlet port, wherein insertion of the replaceable unit into the image forming device causes the shutter to move from the closed position to the open position and removal of the replaceable unit from the image forming device causes the shutter to move from the open position to the closed position.

10. The electrophotographic image forming device of claim 9, wherein the shutter is biased toward the closed position and upon insertion of the replaceable unit into the image forming device along the front-to-rear dimensions of the replaceable unit and the housing, a front face of the T-shaped extension contacts the shutter and pushes the shutter from the closed position to the open position.

11. The electrophotographic image forming device of claim 8, wherein the housing and the outlet port are prevented from moving in the front-to-rear dimension of the housing and the flexible member allows the housing and the outlet port to move in two dimensions perpendicular to the front-to-rear dimension of the housing within the image forming device.

12. The electrophotographic image forming device of claim 8, wherein upon insertion of the replaceable unit into the image forming device along the front-to-rear dimensions of the replaceable unit and the housing, contact between the replaceable unit and the housing lifts the housing to a position where the C-shaped channel of the housing is aligned vertically with the T-shaped extension of the replaceable unit.

13. The electrophotographic image forming device of claim 12, wherein the housing is biased downward.

14. The electrophotographic image forming device of claim 8, wherein upon insertion of the replaceable unit into the image forming device along the front-to-rear dimensions of the replaceable unit and the housing, contact between the replaceable unit and the housing moves the housing to a position where the C-shaped channel of the housing is aligned with the T-shaped extension of the replaceable unit in a side-to-side dimension of the replaceable unit.

15. The electrophotographic image forming device of claim 8, further comprising a shutter positioned on the T-shaped extension that is movable between a closed position blocking the inlet port and an open position unblocking the inlet port, wherein the shutter is biased toward the closed position and upon insertion of the replaceable unit into the image forming device along the front-to-rear dimensions of the replaceable unit and the housing, a front face of a portion of the housing that forms the C-shaped channel contacts the shutter and pushes the shutter from the closed position to the open position.

16. An electrophotographic image forming device, comprising:

a toner channel having a duct in fluid communication with a toner supply of the image forming device, a housing is connected to the duct by a flexible coupling, an outlet port is positioned on the housing, the flexible coupling allows the housing and the outlet port to move relative to the duct and allows toner to pass from the duct to the outlet port, a shutter is positioned on the housing and is movable between a closed position blocking the outlet port and an open position unblocking the outlet port; and a replaceable unit that is insertable into and removable from the image forming device, the replaceable unit includes a toner reservoir and an inlet port in fluid communication with the toner reservoir, the inlet port is formed on an extension from the replaceable unit, wherein upon insertion of the replaceable unit into the image forming device, the extension is closely and matably received by the housing and the outlet port aligns with the inlet port permitting toner transfer from the toner channel to the replaceable unit, wherein insertion of the replaceable unit into the image forming device causes the shutter to move from the closed position to the open position and removal of the replaceable unit from the image forming device causes the shutter to move from the open position to the closed position.

17. The electrophotographic image forming device of claim 16, wherein the flexible coupling allows the housing and the outlet port to move in two dimensions relative to the duct.

18. The electrophotographic image forming device of claim 16, further comprising:

a downward facing C-shaped channel positioned on a bottom of the housing that runs along a front-to-rear dimension of the housing, the outlet port is formed in a bottom surface of the housing that defines a top portion of the C-shaped channel; and the extension from the replaceable unit includes a T-shaped extension that runs along a front-to-rear dimension of the replaceable unit on a top of the replaceable unit, the inlet port is formed in a top surface of the T-shaped extension, wherein upon insertion of the replaceable unit into the image forming device along front-to-rear dimensions of the replaceable unit and the housing, contact between the replaceable unit and the housing aligns the C-shaped channel of the housing with the T-shaped extension of the replaceable unit and the C-shaped channel of the housing closely and matably receives the T-shaped extension of the replaceable unit maintaining the alignment of the C-shaped channel of the housing with the T-shaped extension of the replaceable unit.

19. The electrophotographic image forming device of claim 18, wherein the shutter is biased toward the closed position and upon insertion of the replaceable unit into the image forming device along the front-to-rear dimensions of the replaceable unit and the housing, a front face of the T-shaped extension contacts the shutter and pushes the shutter from the closed position to the open position.

20. The electrophotographic image forming device of claim 18, wherein the housing and the outlet port are prevented from moving in the front-to-rear dimension of the housing and the flexible coupling allows the housing and the outlet port to move relative to the duct in two dimensions perpendicular to the front-to-rear dimension of the housing.

21. The electrophotographic image forming device of claim 16, wherein upon insertion of the replaceable unit into the image forming device, contact between the replaceable unit and the housing lifts the housing to a position where the outlet port of the housing is aligned vertically with the inlet port of the replaceable unit.

22. The electrophotographic image forming device of claim 16, wherein upon a forward sliding insertion of the replaceable unit into the image forming device, contact between the replaceable unit and the housing moves the housing to a position where the outlet port of the housing is aligned with the inlet port of the replaceable unit in a side-to-side dimension perpendicular to the forward sliding insertion of the replaceable unit.

* * * * *